US005738573A

United States Patent [19]

Yueh

[11] Patent Number: 5,738,573

[45] Date of Patent: Apr. 14, 1998

[54] SEMICONDUCTOR WAFER POLISHING APPARATUS

[76] Inventor: William Yueh, P.O. Box 5874, Fullerton, Calif. 92838

[21] Appl. No.: 789,840

[22] Filed: Jan. 29, 1997

[51] Int. Cl.[6] ..... B24B 7/22

[52] U.S. Cl. ..... 451/287; 451/285; 451/288; 451/41

[58] Field of Search ..... 451/41, 285, 287, 451/288, 446

[56] References Cited

U.S. PATENT DOCUMENTS 5,582,534 12/1996 Shendon et al. ..... 451/41
5,597,346 1/1997 Hempel, Jr. ..... 451/287
5,643,053 7/1997 Shendon ..... 451/41
5,647,789 7/1997 Kitta et al. ..... 451/41
5,653,622 8/1997 Drill et al. ..... 451/41

*Primary Examiner*—Eileen Morgan
*Attorney, Agent, or Firm*—Herbert M. Shapiro

[57] ABSTRACT

Semiconductor wafer polishing apparatus, in accordance with the princples of this invention, includes an annular-shaped platen rotatable about a non-rotating center core having a diameter smaller than the width of the annular-shaped platen. The center core is the source of slurry which permits convenient dispensing of slurry. The apparatus includes a bridge which extends from the center core to the rigid table in which the apparatus is housed. The bridge is a convenient support for apparatus for pad rejuvenation and for sensing and correcting wafer attitude and characteristics as well as slurry properties on a real time basis for improving wafer uniformity and local surface planarity.

7 Claims, 6 Drawing Sheets

SEMICONDUCTOR WAFER POLISHING APPARATUS

FIELD OF THE INVENTION

This invention relates to semiconductor wafer, oxide or metal layer polishing apparatus and more particularly to such apparatus which includes a rotating platen against which wafers are positioned for chemical-mechanical polishing.

BACKGROUND OF THE INVENTION

Chemical-mechanical polishing (CMP) techniques for obtaining planar surfaces for semiconductor wafers are well known. Such techniques commonly employ a polishing pad mounted on a circular polishing platen. A wafer is mounted on a wafer carrier and juxtaposed against the pad in the presence of a slurry much in the manner familiar in the polishing of optical lenses. Typically, both the wafer and the pad rotate about respective axes. The wafer, further, is moved about the pad surface, the pad being much larger than the wafer. Thus, a wafer rotates against the pad which itself is rotating. Whether the polishing pad actually contacts the wafer surface or exerts pressure on the slurry to remove material from the wafer surface, the slurry has been found to be required for optimum results to be obtained.

Alternative planarization techniques are also in use. Such techniques are referred to as "dry" techniques and include ion, plasma etching, and spin-on-glass methodologies. The dry techniques had gained popularity as the techniques of choice in wafer polishing. But, as wafer diameter has increased and as smaller and smaller wafer surface feature sizes were demanded, CMP "wet" processing using a pad have been found to be the only technique that can meet the demanding requirements for both global surface uniformity and local planarity.

But there were problems associated with CMP that were compounded by the small critical dimensions required in the small (sub micron) devices that were becoming available. The problems related to uniformity and control of the polishing process itself. For example, multi-level metallization required each semiconductor layer to be uniform so that metal deposition on inter-level dielectric could be controlled properly. Consequently, tighter tolerances were needed for the polishing process to avoid uneven layer thickness or layer penetration. Layer thickness had to be more uniform and irregularities on a wafer surface had to be reduced to more acceptable levels in order to achieve acceptable level of uniformity between wafers.

Efforts have been made to achieve greater uniformity and to reduce surface irregularities. U.S. Pat. No. 5,562,530 issued Oct. 8, 1996, for example, describes a technique for pulsing the wafer carrier to vary the distance between the pad and the wafer surface and thus to vary the downward force on the wafer. This action allows the slurry to provide better lubrication of the wafer surface when the force is at a minimum. It is argued that the pulsed technique allows for a substantially continuous and controllable slurry transport process for polishing semiconductor wafers.

But problems still remain with respect to slurry effectiveness, the out of plane positioning of the wafer itself, the need to remove the wafer from the apparatus for testing, and the inability of determining easily when the desired surface characteristics have actually been achieved, all of which problems effect layer uniformity, the level of surface irregularities, and process throughput.

BRIEF DESCRIPTION OF THE INVENTION

In accordance with the principles of this invention, rather than having a rotating circular platen on which a polishing pad is mounted, a rotating annulus is used with a non-rotating center core. In a representative configuration for eight inch diameter wafers, the core diameter and the width of the rotating annular portion of the polishing apparatus are, each, about eight inches although the core diameter may be much smaller if desired. The presence of the non-rotating core permits a bridge to be placed conveniently between the core and a table support in which the annular portion rotates. The core permits the location of the slurry inlets to ensure uniform slurry distribution over the wafer surface. The bridge permits the convenient location of in situ pad conditioning devices and ultrasonic transducers to enhance the slurry flow into the tightly pressed polishing area. The transport effect will be more pronounced with a grooved pad.

DETAILED DESCRIPTION OF AN ILLUSTRATIVE EMBODIMENT OF THIS INVENTION

Figure 1:
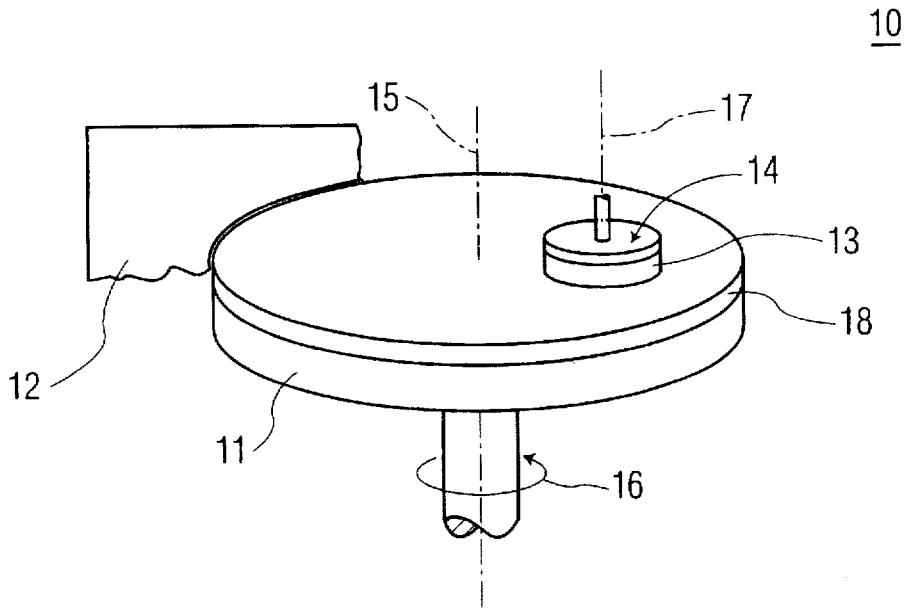
FIG. 1 PRIOR ART
FIG. 1 is a schematic top view of a prior art CMP apparatus for semiconductor wafer surface planarization.

FIG. 1 shows a prior art CMP apparatus 10. The apparatus includes a platen 11 which rotates in a plane defined at the top surface of a rigid table 12, shown broken away. A semiconductor wafer 13, to be planarized, is mounted on a wafer carrier 14 and juxtaposed with platen 11. The platen is rotated about an axis 15 as indicated by the curved arrow 16. The wafer is rotated about an axis 17. Thus, polishing of the wafer results from pressure between the wafer and a polishing pad 18 mounted on the surface of the platen as the platen and the wafer are rotated about respective axes in the presence of a slurry. Note that in the prior art device, the platen has a circular configuration and rotates about a center axis.

Figure 2:
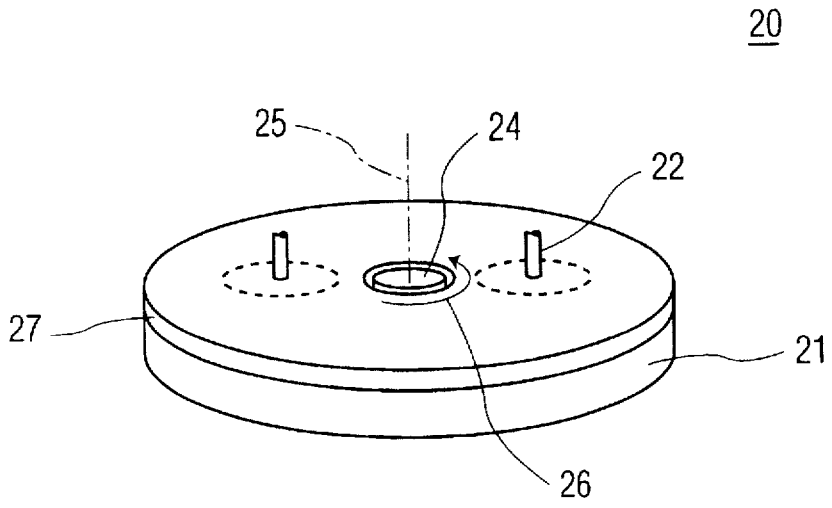
FIG. 2 is a schematic top view of a CMP apparatus for semiconductor wafer surface planarization in accordance with the principles of this invention.

FIG. 2 shows a CMP apparatus 20 in accordance with the principles of this invention. The apparatus includes a platen 21 against which a semiconductor wafer is juxtaposed for polishing much as shown and described in connection with FIG. 1. The position of the wafer is indicated by the broken circle 22 in FIG. 2. To be more cost effective and to increase the throughput time for CMP processing, a dual head, dual spindle arrangement is indicated at 23. The apparatus can house up to four individual polishing heads with four independently controlled rotating spindles. But, the platen, 21, in this instance is annular in shape having a non-rotating center core 24. The annular portion rotates, illustratively, counterclockwise, about an axis 25 as indicated by curved arrow 26. As is the case with the apparatus of FIG. 1, the wafer, in the apparatus of FIG. 2, is mounted on a wafer carrier and rotated about it's own axis, during operation, while it is juxtaposed with a polishing pad 27 mounted on the annular portion of the apparatus of FIG. 2. Typically, the center core, in FIG. 2, has a diameter smaller than that of the width of the annular portion. For an eight inch diameter wafer, the width of the annular portion is a little bigger than eight inches to accomodate the wafer positioning and movement requirements.

The presence of a stationary (non-rotating) center core in the plane of rotation provides a convenient position for slurry dispensing and as a bridge support as will become clear hereinafter.

Figure 3:
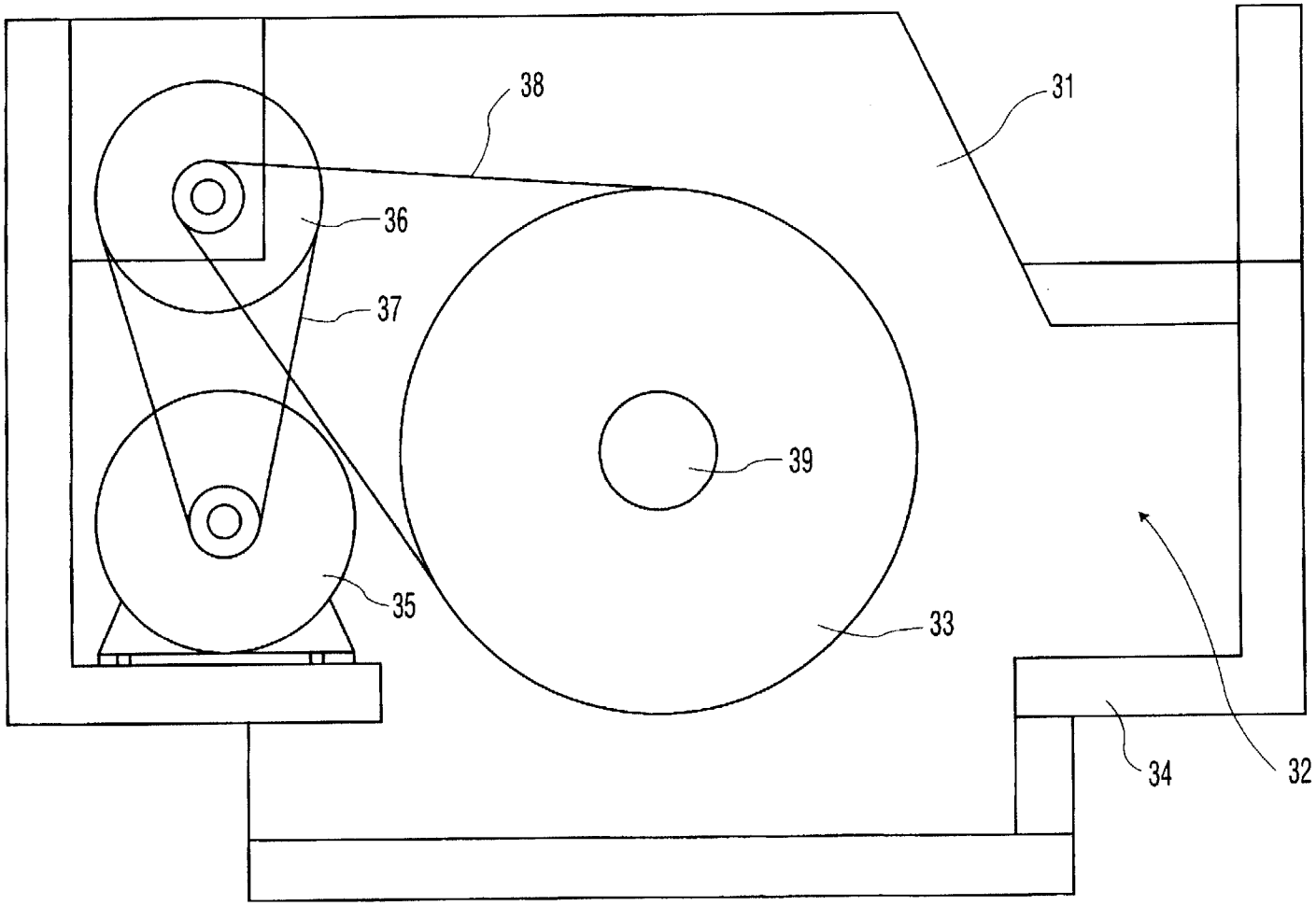
FIG. 3 is a schematic top view of the apparatus of the type shown in FIG. 2.

The presence of a non-rotating center core is more compatable with a periphery drive arrangement rather than the center axis drive arrangement used in prior art devices. FIG. 3 shows one such arrangement that alleviates the cantilever error as compared with the center axis drive mechanism with off-center down force applied during polishing. Specifically, FIG. 3 shows a top view of the apparatus 30 including a rigid table 31 having a top surface 32 in the plane of which a platen 33 rotates. The figure also shows a rigid frame 34 to which a motor 35 and a pulley arrangement 36 are mounted. The motor drives the pulley via a belt 37. The pulley, in turn, drives platen 33 via belt 38 coupled to the periphery of the platen as shown. The platen rotation thus can be implemented with assemblies of high grade thrust and radial bearings, pulley and belt mechanism to eliminate totally the vertical error in bearing give in, translating the vertical error to horizontal error which is more tolerable.

Figure 4:
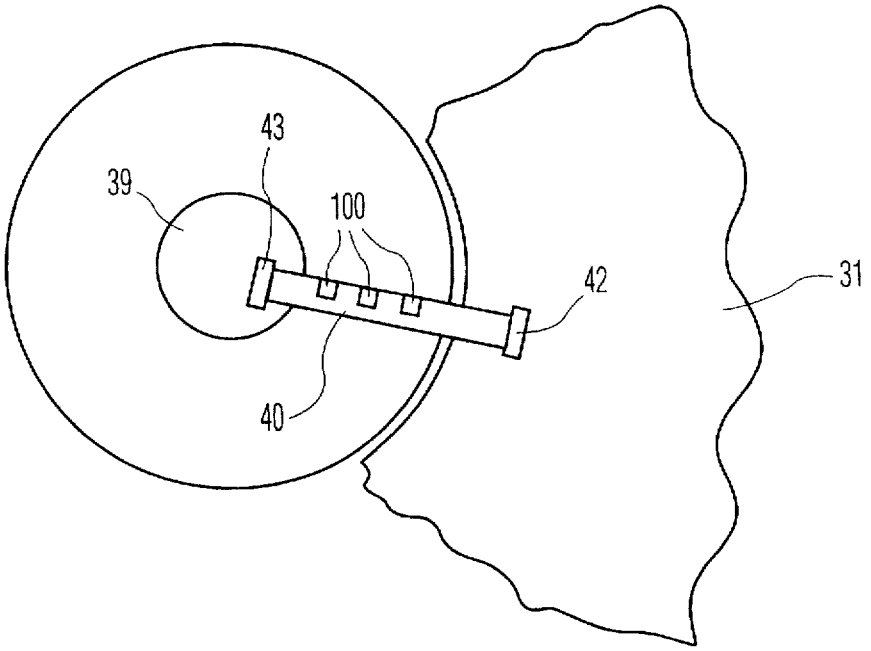
FIG. 4 is a schematic top view of an alternative embodiment of apparatus of the type shown in FIG. 2.

FIG. 4 shows a top view of the apparatus of FIG. 2 showing a bridge 40 extending from center core 39 of the apparatus to the rigid table 31. The non-rotating core and bridge supplies a convenient support for sensors for the real time measurement of wafer attitude and surface characteristics for determining when the polishing process is completed. Such sensing permits the correction of wafer position and non uniformity of processing without the removal of the wafer from the apparatus. In one embodiment, the bridge is hinged to table 31 at hinge 42 and is coupled to center core 39 by a releasable latch 43.

Figure 5:
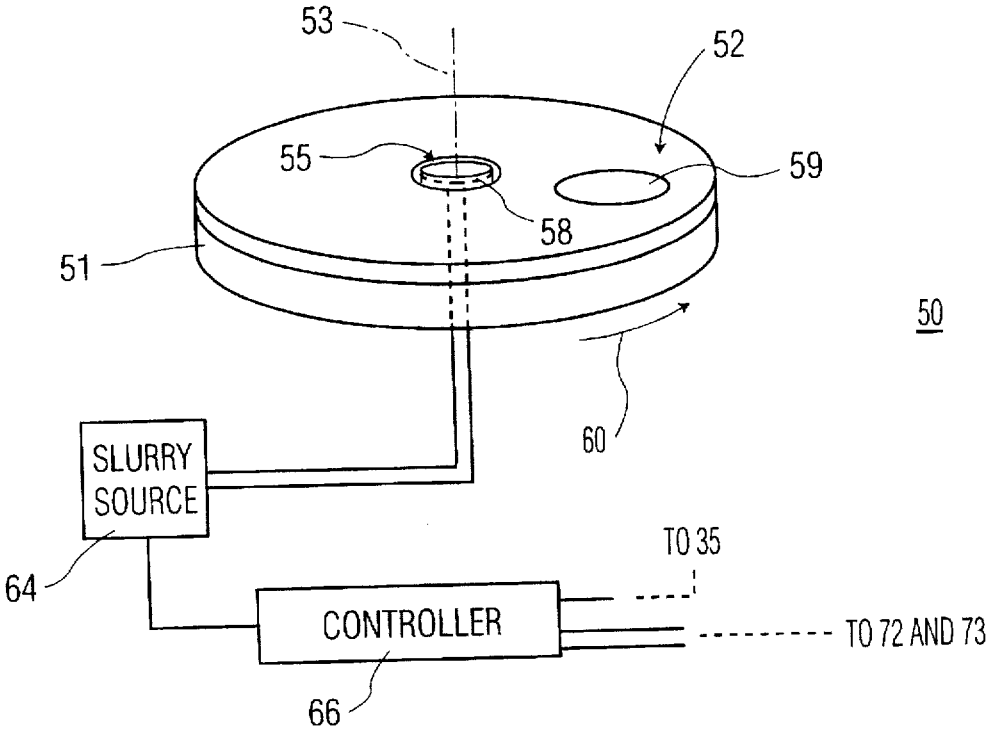
FIG. 5 is a schematic representation of a slurry delivery system for apparatus of the type shown in FIG. 2.

FIG. 5 shows an embodiment of this invention where the apparatus 50 includes a platen 51 which is annular in configuration and is rotatable in a plane of movement 52 about an axis of rotation 53 as represented in FIG. 3. The apparatus has a non-rotating center core 54 which, in this embodiment, has a top surface 55 which is higher than the plane of rotation of the annular platen exposing a cylindrical portion 57 of the side of the center core. The exposed surface portion includes at least one opening 58 for the dispensing of slurry into the path of a wafer moving in the plane of movement. A wafer to be polished is represented by circle 59 and the direction of wafer movement is, illustratively, counterclockwise as indicated by curved arrow 60.

The slurry is introduced into the (hollow) core 54 by a tube 61 connected, into a well 63 in the head of the center core or directly to opening 58. Tube 61 is connected to a source of slurry 64 operative to pump slurry onto the platen (the polishing pad on the surface of the platen) in the path of the rotating wafer. The dispensing of the slurry in this manner is controlled by a controller 66 which also is operative to control a metered pump (not shown) to deliver the slurry through a fine spray nozzle. The controller also is operative to control a motor (i.e. 35 of FIG. 3) for turning the platen. The slurry can also be released from the bridge structure with evenly distributed holes and preset hole sizes.

Figure 6:
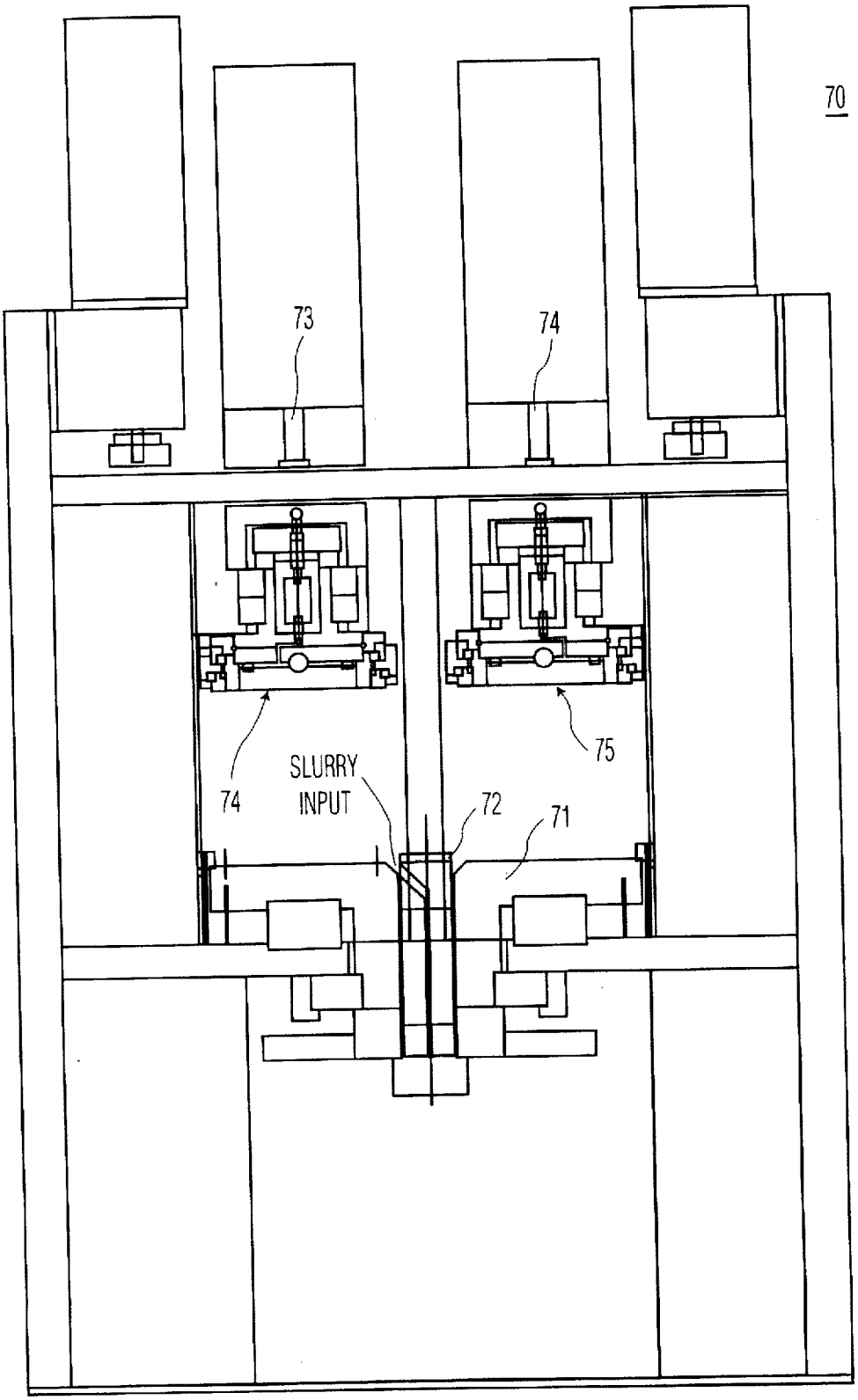
FIGS. 6 and 7 are detailed side views of apparatus of the type shown in FIG. 2 showing a dual head and a single head assembly respectively.

FIG. 6 shows a schematic side view of apparatus 70 of the type shown in FIGS. 2 through 5 adapted for polishing more than one wafer at a time. The apparatus includes a platen 71 on which a polishing pad is mounted. The platen has an annular configuration and a stationary center core 72. The apparatus also includes first and second actuators 73 and 74 at the lower end of which wafer holder assemblies 74 and 75 are attached, respectively. The actuators, which can be pneumatic, hydraulic, or mechanical, are operative under the control of controller 66 of FIG. 5 for moving wafers along the linear stage of movement and applying down force (52 of FIG. 3) for polishing.

Figure 7:
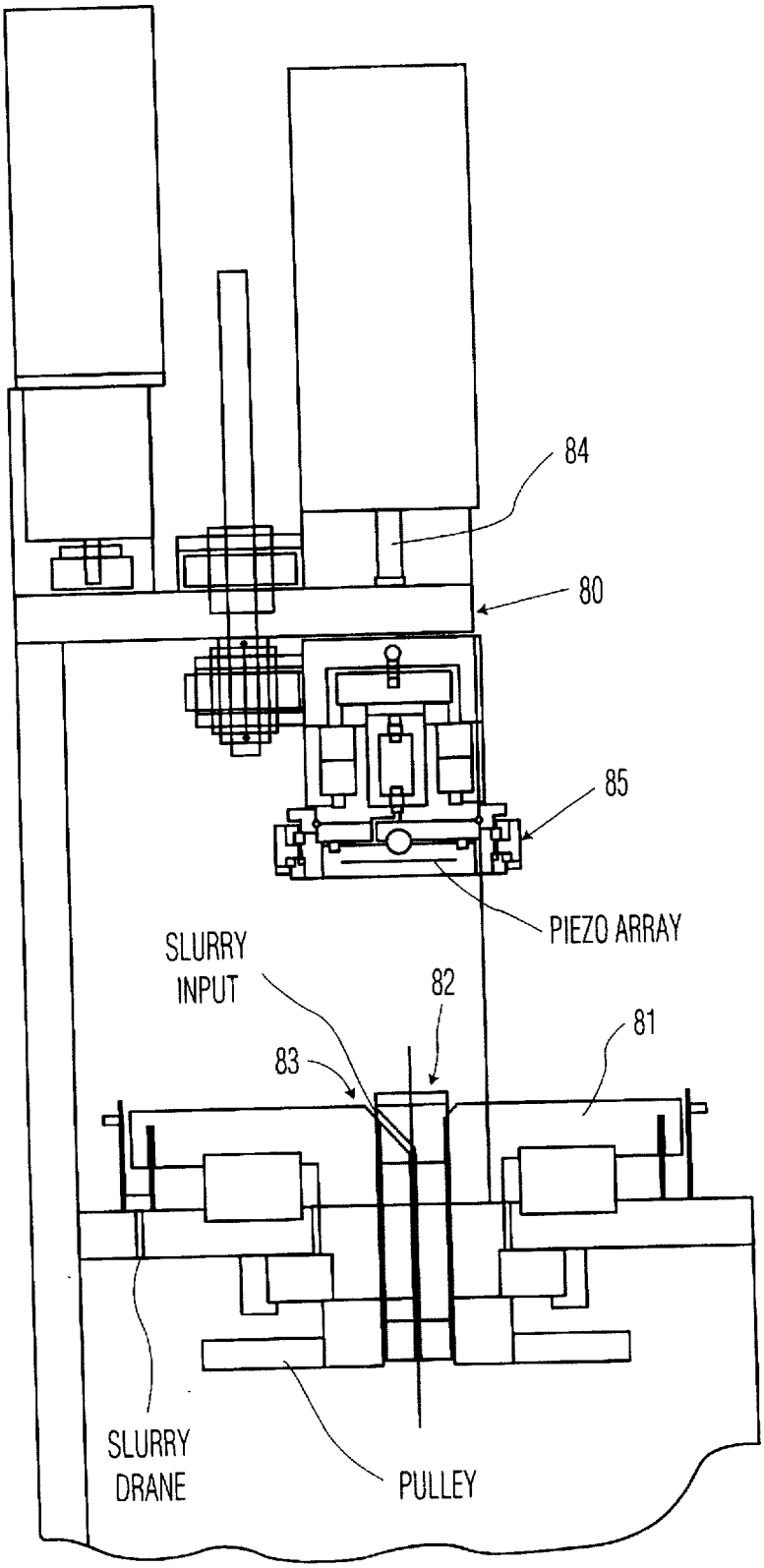

FIG. 7 shows a schematic side view of apparatus 80 of the type shown in FIGS. 2 through 5 adapted for polishing a single wafer. The figure shows a platen 81, of annular configuration, with a stationary core 82. The core is hollow and includes a slurry tube connected directly to a dispensing vent in the exposed side wall 83 at the top of the center core. The figure also shows an actuator 84 operative to lower the wafer holding assembly 85 against the platen also under the control of a controller (see 66 in FIG. 5).

Figure 8:
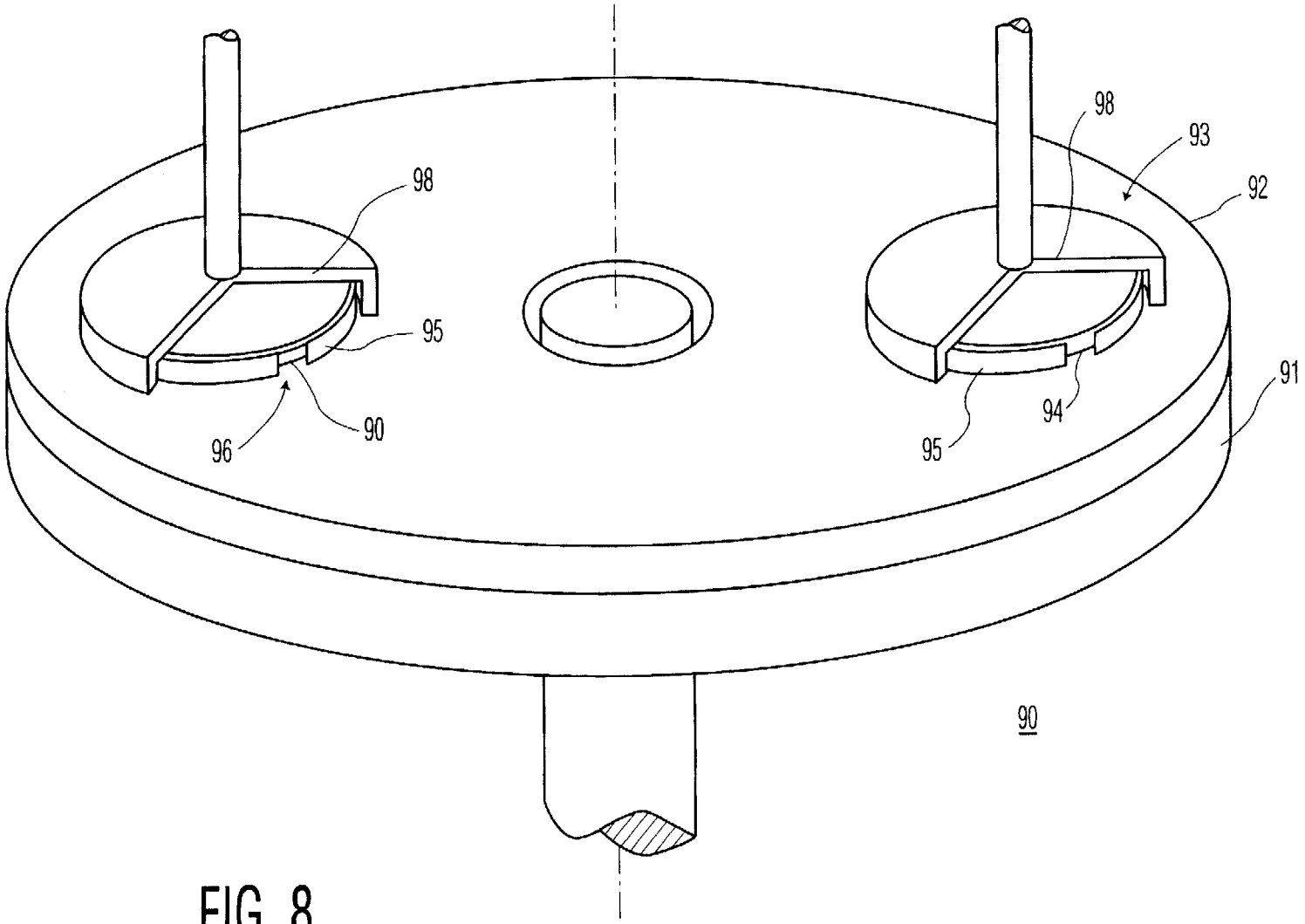
FIG. 8 is a perspective view of a wafer carrier assembly for apparatus of the type shown in FIG. 2.

FIG. 8 shows a perspective view of a CMP apparatus 90 showing a platen 91 with a polishing pad 92 mounted thereon in a plane of movement 93. A wafer 94 is moved into position (by the actuator of FIGS. 6 or 7) for polishing. The wafer, in accordance with the principles of this invention, is contained within a retainer ring 95 which includes a narrow opening 96 to ensure that the precission feed slurry is delivered to the wafer and not deflected by the retainer ring. The slurry is delivered, advantageously, just prior to the time at which the wafer is brought into juxtaposition with the polishing pad. The wafer, itself, is positioned by a wafer guard 98 which resides within the retainer ring (with a one inch, or smaller, separation from it). The slurry is dispensed between the wafer guard and the retainer ring to ensure slurry flow directly into the polishing area. Further, the wafer is positioned at an attitude where the leading edge of the wafer is elevated one to two microns over the trailing edge, while rotating, so that the slurry flows under the wafer into the polishing area. The elevation of the leading edge of the wafer avoids possible damage to the leading edge by pad grabbing during motion and permits a more uniform pressure to be maintained over the edge of the wafer as compared to the center portion of the wafer.

The bridge (see 40 of FIG. 4) provides a convenient support for a plurality of in situ mechanisms 100 for maintaining the optimum condition of the polishing pad and for controlling the slurry properties. For example, an electrostatic mini brush (or magnetic brush) assembly can be mounted on the bridge with appropriate vacuum suction to extract potentially harmful by-products of the polishing process. The minibrush assembly is mounted on the side of the bridge away from the polishing area while the slurry feed channel is positioned on the side facing the polishing area so that fresh slurry will be layered upon a "swept clean" pad. Also, miniaturized ultrasonic transducers operating at about 300 KHz can be mounted on the bridge. The ultrasonic transducers are made of PZT 5 material and are arranged to push the slurry under the tightly pressed, wafer center area. The acoustic energy is transmitted directly to the polishing area to activate the layer removal process. The acoustic wave induces longitudinal slurry vibrations along the annular circular path above the pad surface. It should be obvious that a grooved pad with circular grooves provides ideal channels for slurry to be supplied right under the wafer. The induced surface vibrations also allow the pad fibers to oscillate with rejuvenating force to achieve more efficient polishing actions on the wafer surface.

What is claimed is:

1. Apparatus for polishing semiconductor wafers, said apparatus including a platen, said platen comprising an annular-shaped, planar member and means for rotating said platen in a plane of movement about a first axis normal to said plane of movement, said platen having a polishing pad mounted on a top surface thereof said apparatus also including a center core about which said annular member rotates, said center core having a central axis coincident with said first axis and being non-rotating.

2. Apparatus as in claim 1 including a rigid table having a top surface, said annular-shaped platen rotating in a plane of movement defined by said top surface.

3. Apparatus as in claim 2 wherein said center core has a top surface which extends above said plane of movement exposing the side surface thereof, said side surface including at least one vent for the dispensing of slurry, said vent being coupled to a source of slurry.

4. Apparatus as in claim 2 also including a bridge extending from said rigid table to said center core overlying said annular member.

5. Apparatus as in claim 4 wherein said bridge is connected to said rigid table by a hinge whereby said bridge can be moved clear of said annular member, said bridge being connected to said center core by a releasable latch.

6. Apparatus as in claim 1 wherein said apparatus also including a wafer carrier and means for juxtaposing said wafer carrier against said platen, said wafer carrier including therein a guard ring for positioning a wafer within said carrier, said carrier also having a side wall with an opening therein for accepting slurry.

7. Apparatus as in claim 6 also including means for synchronizing the dispensing of the slurry with the position of said side wall opening with said vent.

* * * * *